US006491133B2

(12) United States Patent
Yamada et al.

(10) Patent No.: US 6,491,133 B2
(45) Date of Patent: Dec. 10, 2002

(54) SOUNDPROOF TYPE ENGINE DRIVEN WORK MACHINE

(75) Inventors: Masao Yamada, Fukui (JP); Susumu Torii, Fukui (JP)

(73) Assignee: Denyo Co. Ltd., Tokyo (JP)

( * ) Notice: Subject to any disclaimer, the term of this patent is extended or adjusted under 35 U.S.C. 154(b) by 63 days.

(21) Appl. No.: 09/790,804

(22) Filed: Feb. 23, 2001

(65) Prior Publication Data

US 2002/0000342 A1 Jan. 3, 2002

(30) Foreign Application Priority Data

Jun. 22, 2000 (JP) ..... 2000-187299

(51) Int. Cl.[7] ..... G10K 11/04

(52) U.S. Cl. ..... 181/200; 181/204; 180/69.22; 123/195 C

(58) Field of Search ..... 181/200, 202, 181/204, 211; 180/69.22; 123/41.7, 195 C, 195 E

(56) References Cited

U.S. PATENT DOCUMENTS 4,114,714 A * 9/1978 Fachbach et al. ..... 181/204
4,122,908 A * 10/1978 Miers et al. ..... 181/211
4,324,208 A * 4/1982 Danckert et al. ..... 181/204

* cited by examiner

*Primary Examiner*—Khanh Dang
(74) *Attorney, Agent, or Firm*—Liniak, Berenato & White

(57) ABSTRACT

The soundproof casing is divided to an engine room (1), a muffler room (2) and a radiator room (3). The engine room (1) includes the engine E and a work machine unit (generator unit G). The muffler room (2) includes mufflers M1, M2. The radiator room includes a radiator R. An electric fan D is provided between an air intake aperture (22*a*) and the radiator. The radiator room and the muffler room are communicated. An air flow duct (4) to communicate the engine room and the muffler room is provided. An engine fan F is provided just opposite to an entrance of the air flow duct. An inter-cooler I is provided in the air flow duct. The soundproof type engine driven work machine including aforementioned apparatuses is offered to improve the cooling efficiency as well as reducing unfavorable noise.

2 Claims, 9 Drawing Sheets

SOUNDPROOF TYPE ENGINE DRIVEN WORK MACHINE

BACKGROUND OF THE INVENTION

1. Field of the Invention

The present invention relates to a soundproof type engine driven work machine (hereinafter referred to as work machine), and more particularly relates to a construction of introducing the cooling air into a soundproof casing accommodating an engine driven work machine unit.

2. Prior Art

A work machine unit accommodated within a soundproof casing has been conventionally used to reduce uncomfortable noise. A soundproof type engine driven generator (hereinafter referred to as generator) is explained as a typical example of this kind of work machines.

As shown in FIG. 1, main part of the generator comprises a generator unit G" as a work machine unit, an engine E" of which rear end power axis is communicated to the generator unit G', a muffler M" connecting to the engine E", an air-cooled type inter-cooler I" acting as a charge cooler, and a radiator R". An engine fan F" is directly provided to the front end of said engine E" and driven by said engine E. Directly opposite to said engine fan F" the inter-cooler I" and the radiator R" are aligned in consecutive order from right to left in FIG. 1. All abovementioned parts are accommodated in a soundproof casing K" to reduce uncomfortable noise. There are provided an air intake aperture 31*a*" on the rear side of said soundproof casing K and an air exhaust aperture 25*a*" on the ceiling at front side.

While said generator being driven, the heat generated from the generator unit G", the engine E", the inter-cooler I", the radiator R" and the muffler M" is cooled by the cooling air flowing through the soundproof casing K. The cooling air is introduced into the soundproof casing K through the air intake aperture 31*a*" by rotating the engine fan F". The cooling air passes through an air flow passage formed in the soundproof casing K consecutively as cooling the generator unit G", the engine E", the inter-cooler I", the radiator R" and the muffler M" and is exhausted through the exhaust aperture 25*a*.

However, it has been pointed out that the cooling air is warmed up because it goes through the intake aperture 31*a*", the generator unit G", the engine E", the inter-cooler I", the radiator R" and the muffler M" while passing through the soundproof casing K, the cooling air is warmed up by the heat of the air already cooled the aforementioned apparatuses. As the cooling air approaches the exhaust aperture 25*a* said cooling air to cool the inter-cooler I", the radiator R" and the muffler M" is already warmed up. Thus, the cooling efficiency is much reduced.

In order to overcome such undesirable efficiency reduction it is naturally required to supply more additional cooling air into the soundproof casing K so that the cooling air may cool the inter-cooler I", the radiator R" and the muffler M" sufficiently. In other word, it was required to enlarge the areas of the intake aperture 31*a*" and the exhaust aperture 25*a*" or expand the capacities of the radiator R", the inter-cooler I" and the engine fan F".

In the meantime, the conventional generator in which the inter-cooler I" and the radiator R" are provided opposite to the engine fan F" is pointed out that the combustion sound of the engine E" or the machine sound (hereinafter referred to as engine sound) which is the main cause of the engine sound is leaked outside through the air intake aperture 31*a*" or the air exhaust aperture 25*a* after passing through the core part of the radiator R".

For this reason, if the area of the air intake aperture 31*a*" or the air exhaust aperture 25*a*" should be enlarged, the engine sound during the operation of the generator is accordingly much enlarged. Meanwhile, if the capacities of the inter-cooler I" and the radiator R" are enlarged, a more larger inter-cooler I" and a more larger radiator R" are required and thus the dimension of the core part is enlarged and the engine sound passing through the said core part becomes larger. The engine sound becomes larger more and more. This is a big problem of the engine sound.

In the meantime, to reduce the leakage of the noisy sound from the soundproof casing K", it is required to reduce the areas of the aperture of the air intake aperture 31*a*" and the air exhaust aperture 25*a*". Further it is required to provide an element to shut the transmission of the noisy sound in the cooling air passages in the casing K or to provide some bending parts in the passages to obstruct the pressure is also required. However, against such construction, it is pointed out that the volume of the cooling air is reduced and cooling efficiency at each apparatus is reduced.

Accordingly, improving the cooling efficiency and reducing the noisy sound at each apparatus conflict with each other.

Furthermore, if the volumes of the inter-cooler I", the radiator R", the engine fan F, etc. are enlarged, the configuration dimension of the soundproof casing K which accommodates these apparatuses is accordingly enlarged. This will be in conflict with the concept that the size of the generator should be small.

SUMMARY OF THE INVENTION

The present invention has been made with the foregoing background in mind. The object of the present invention is to offer a soundproof type engine driven work machine to improve the cooling efficiency and reduce the noise.

In order to resolve the foregoing detects, the soundproof type engine driven work machine according to the present invention is provided with an engine with an engine fan, a work machine unit driven with said engine, a radiator connected to the engine, a charge cooler and the muffler. These apparatuses are accommodated in the soundproof casing. The soundproof casing is divided to an engine room, a muffler room and a radiator room in which said engine as well as said work machine unit being housed in the engine room, said muffler being housed in said muffler room and said radiator being housed in said radiator room. Said engine room is provided with the air intake aperture, said muffler room being provided with the air exhaust aperture, said radiator room being provided with the air intake aperture, respectively. Said radiator room and said muffler room are communicated each other. An electric fan is provided between said air intake aperture in the radiator room and said radiator. Further, an air flow duct is provided between said engine room and said muffler room. The engine fan is provided directly opposite to an inlet of the air flow duct. In the air flow duct there is provided said charge cooler. This is the main characteristic of the soundproof type engine driven work machine according to the present invention.

The charge cooler indicates an apparatus to cool the air for combustion the engine which has been supercharged by compression. It indicates an inter-cooler or an after cooler apparatuses.

The air intake aperture and the air exhaust aperture formed in each room introduces and exhausts the air through each aperture, respectively.

Accordingly, the soundproof casing is divided to the engine room, the muffler room and the radiator room. The engine room encloses the engine and the work machine unit, the muffler room encloses the muffler and the radiator room encloses the radiator, respectively. The radiator room is provided with the electric fan and the air flow duct is provided with the air-cooling apparatus. Thus, cooling efficiency for the apparatus in each room is greately improved.

In radiator room, a clear non-heated air introduced from outside through the air intake aperture by means of electric fan is used for cooling said electric fan and the cooling air only used for cooling the electric fan is used for cooling the radiator. Thus cooling efficiency is greately improved.

The cooling air in the engine room and the air flow duct for cooling the work machine unit, the engine and the charge cooler is sucked from the air intake aperture of the engine room by means of the engine fan provided in the engine. The cooling air travels from the work machine unit and the engine and is introduced to the air flow duct to cool the charge cooler. Further, after passing through the muffler room and the engine room, the muffler is cooled by the air introduced from the air flow duct, or the cooling air introduced from the radiator room. The cooling air used is not the air used for cooling all of the engine, the charge cooler and the radiator. Thus cooling efficiency is improved.

Further, cooling of the radiator is not required; it becomes possible to decrease the amount of the cooling air. Thus, the size of the engine fan can be reduced. Like that, as necessary amount of the cooling air for cooling each apparatus is decreased, smaller size of engine is available when compared with the conventional apparatus. Areas of the air intake aperture and the air exhaust aperture can be reduced. Also, it is possible to place an element to prevent noise propagation in air flow passage, or to provide a bent to disturb the inside pressure. It is possible to decrease the noise leaking out to the exterior of the soundproof casing.

Further, the size of the electric fan can be reduced because it cools only the radiator efficiently with aligned flow of the cooling air. The wind-cut noise from the core of the radiator is reduced. The noise is also greately reduced by preventing it from leaking out through the air intake aperture by means of the electric fan.

As the muffler room and the radiator room are communicated, if the electric fan in the radiator room should be stopped due to some unknown reasons, the cooling air is introduced from the muffler room to the radiator room by closing the exhaust aperture of the muffler room, the cooling air is exhausted through the air intake aperture of the radiator room after cooling the radiator. For this reason, the generator is continuously operated under the lower load operating condition.

Further, the present invention is characterized in that an air exhaust aperture of the muffler room is provided at the ceiling part of the soundproof casing of the soundproof type engine driven work machine.

Accordingly, the exhaust air of the muffler room and the exhaust air of the radiator room are exhausted from the air exhaust aperture of the muffler room provided at the ceiling of the soundproof casing. The air absorbs the heat of the engine, the charge cooler and the muffler, or the heat of the radiator. The heated air goes upward and is exhausted through the air exhaust aperture. The air exhaust efficiency is greately improved. The noise from the air exhaust aperture is diffused upward above the ceiling of the soundproof casing. Thus, the unfavorable noise near the work machine is particularly reduced.

DETAILED EXPLANATION OF THE PREFERRED EMBODIMENTS OF THE INVENTION

Now an example of the preferred embodiments of the soundproof type engine driven work machine according to the present invention is explained with reference to the accompanying drawings.

In the following explanation, the left and the right of a soundproof casing K correspond to the left and the right of the soundproof casing K when observed it from a rear frame 31 direction.

(1) Overall Construction of the Generator

Figure 3:
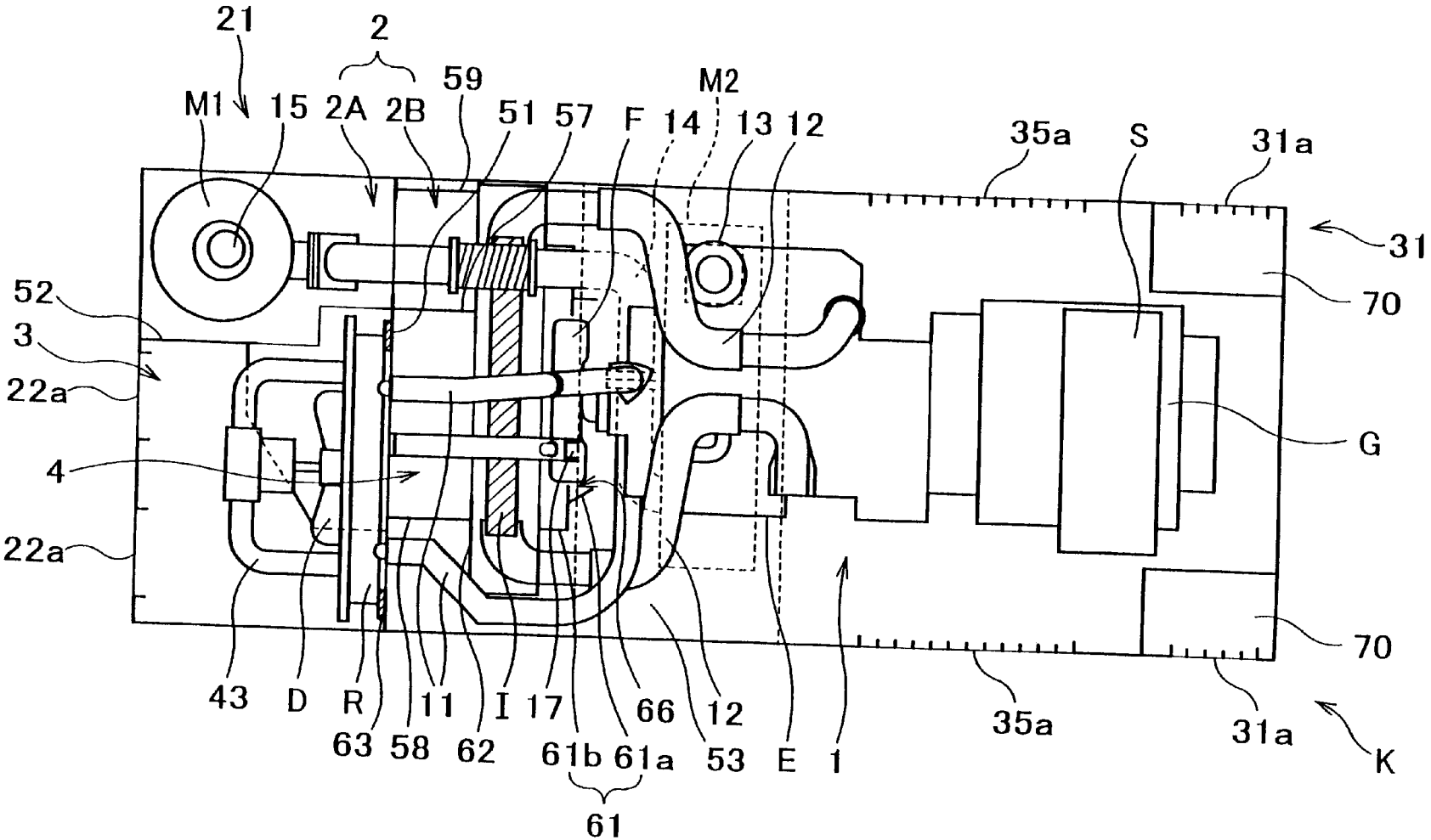
FIG. 3 is a plan view of the soundproof type engine driven work machine (generator) according to the present invention.
Figure 4:
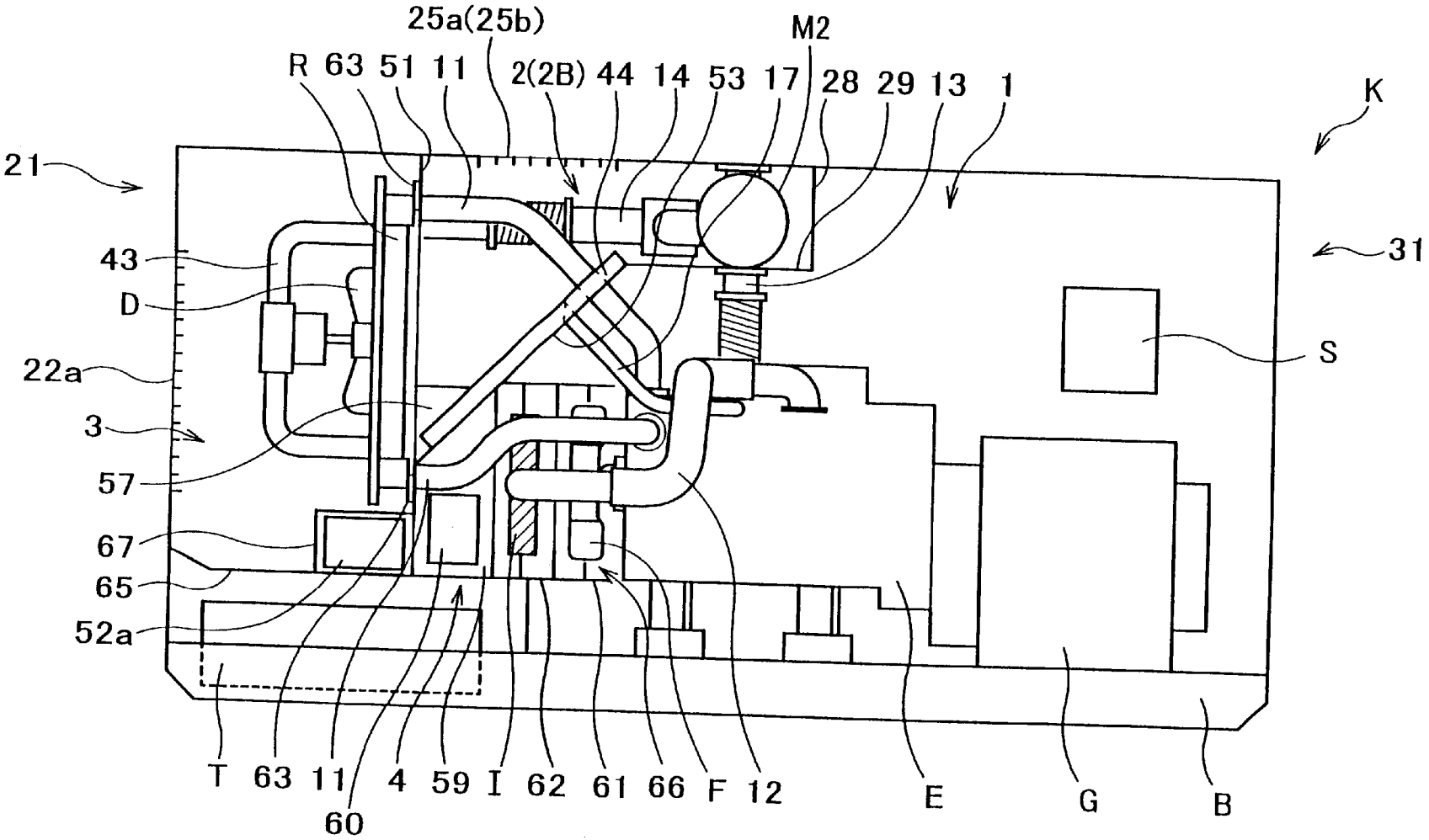
FIG. 4 is a side elevation view of the soundproof type engine driven work machine (generator) according to the present invention.
Figure 5:
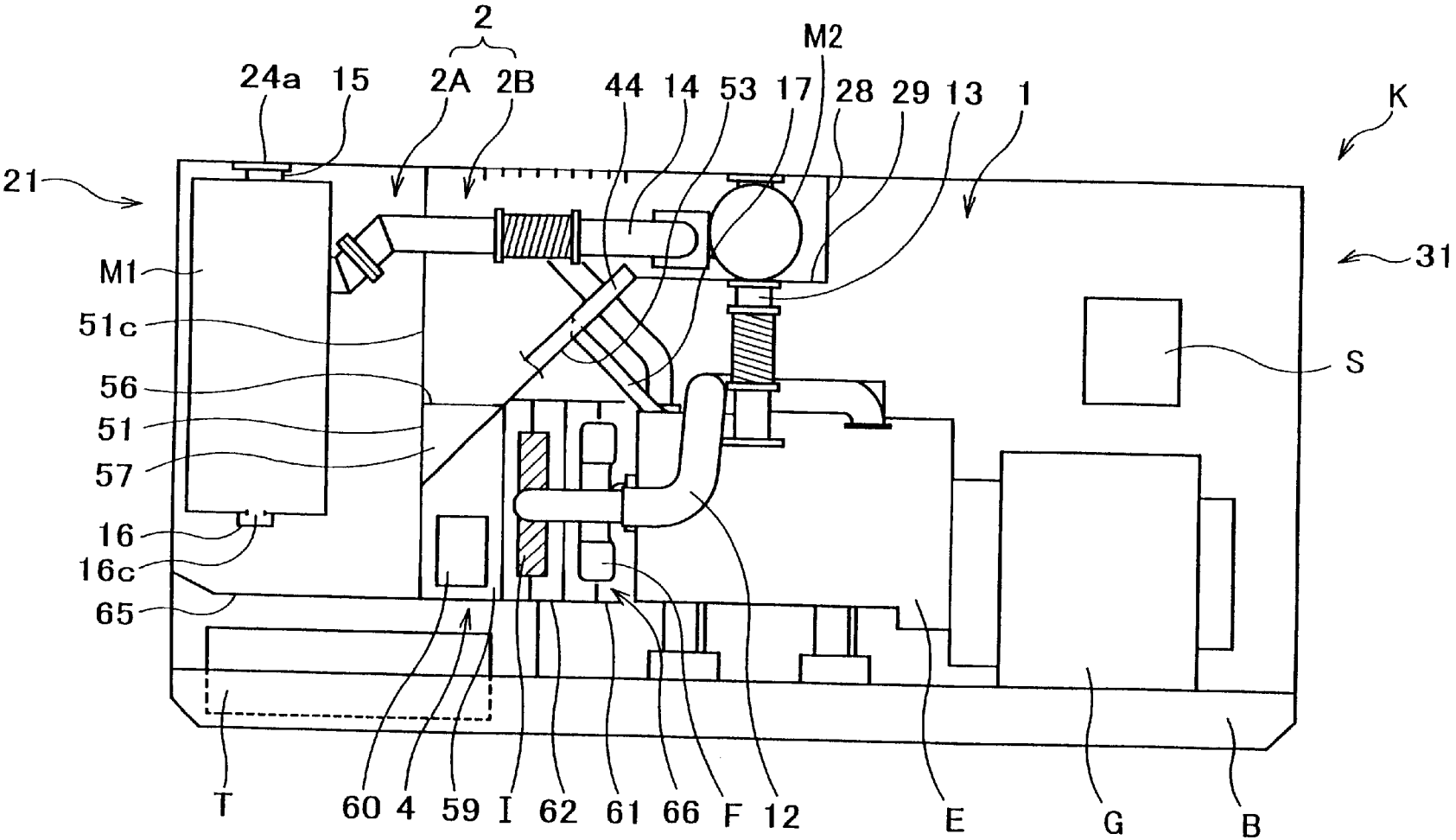
FIG. 5 is a side elevation view of the soundproof type engine driven work machine (generator) according to the present invention (a radiator room is omitted).

The generator according to the present invention, as shown in FIGS. 3, 4, 5, comprises a generator unit G as a work machine unit, an engine E provided with an engine fan F, a radiator R, said radiator being connected to the engine E through a radiator hose 11 to cool the cooling water of the engine E, an inter-cooler I, said inter-cooler I being provided with a turbo charger connected to the engine E via inter-cooler hose 12 to cool the high temperature air compressed by the turbo charger, a first muffler M1 and a second muffler M2, said mufflers being connected through the engine E and exhaust pipes 13, 14, and an electric fan D to cool the radiator R. Each of the aforementioned apparatuses is accommodated within the soundproof casing K.

(2) Overall Construction of the Soundproof Casing K

Figure 1:
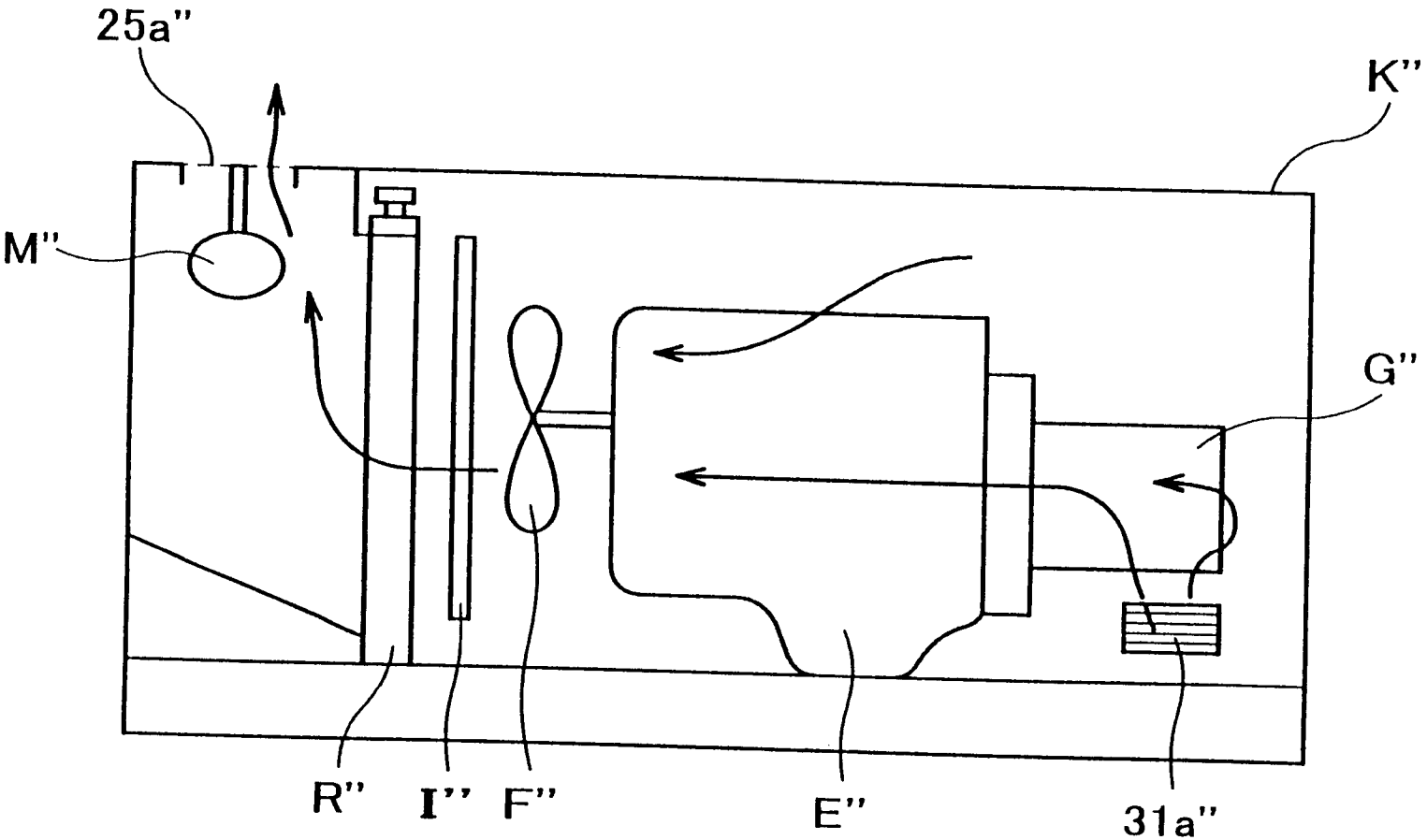
FIG. 1 PRIOR ART
FIG. 1 is a brief side elevation view of the conventional generator.
Figure 2:
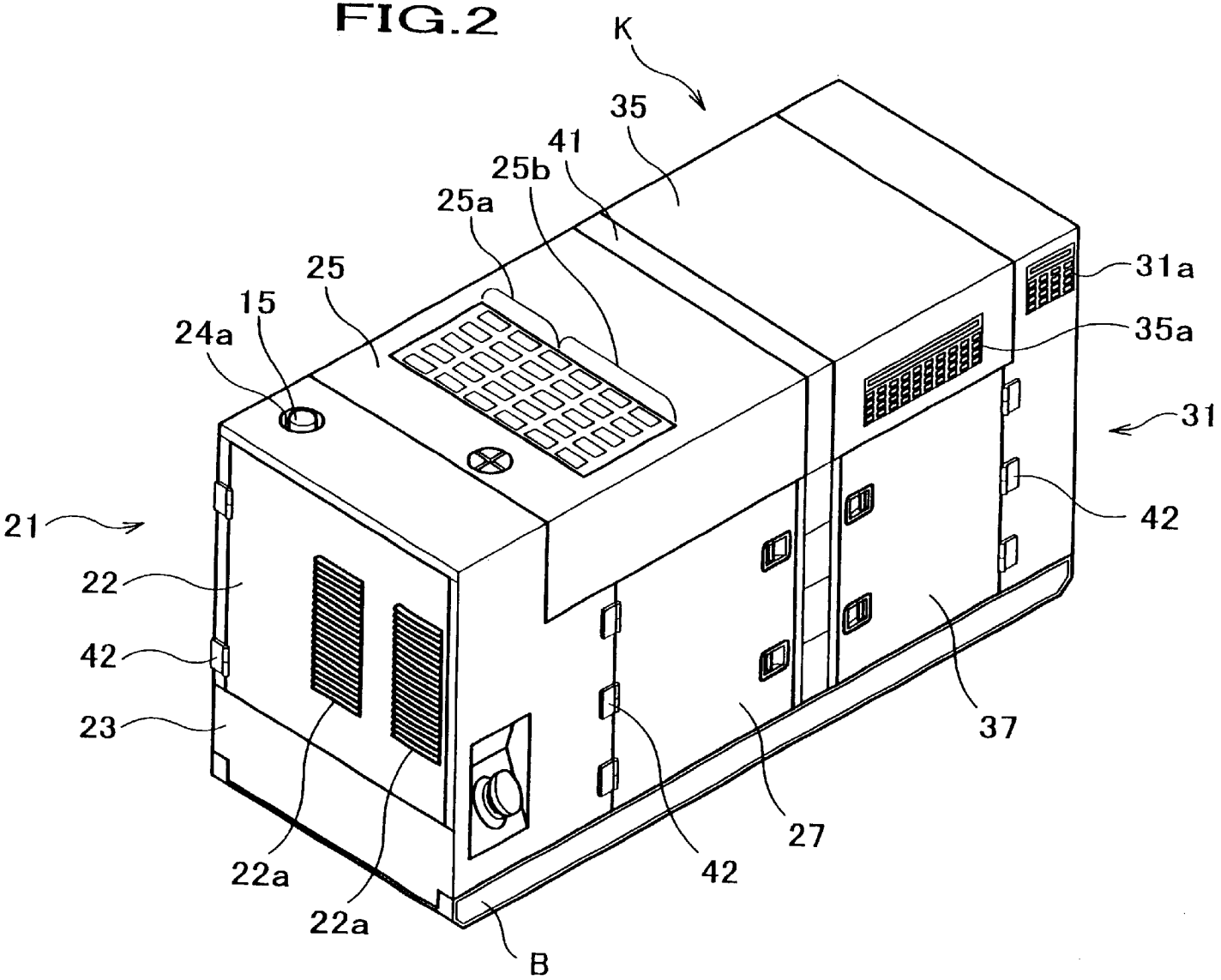
FIG. 2 is a perspective view illustrating a soundproof type engine driven work machine (generator) according to the present invention.

The soundproof casing K, as shown in FIG. 2, comprises a front frame 21, a rear frame 31 and a center frame 41 as a mainframe. The three frames are constructed together on a base plate B.

The front frame 21 and the rear frame 31 are structural components having a gate configuration provided with a ceiling. The components form a front part of the soundproof casing K, a part of the left and the right sides and a part of the upper face, a rear part of the soundproof casing K, a part of the left and the right sides and a part of the upper face of the rear part.

A front door 22 is provided to the front frame 21 by means of a hinge 42. The front door 22 is openably attached and it is easy to check the inside. Further, an air intake aperture 22*a* of the radiator room to introduce a cooling air is formed at a position directly opposite to a radiator room 3 (to be explained later on) of the front door 22. There is provided a front panel 23 by means of the hinge at lower part of the front door 22. If the front panel 23 is removed a fuel tank T housed inside the front panel 23 is detachably placed.

In the upper half of the rear frame 31 a rear door (not shown) is openably secured in the horizontal direction by means of a hinge. There is provided an operation panel (not shown) inside the rear door. An air intake aperture 31*a* to introduce the cooling air into the engine room 1 is formed at upper parts of both left and right sides of the rear frame 31.

A center frame 41 is a structural component having a gate configuration and provided substantially in the center of the longitudinal direction of the soundproof casing K. In the left side of the soundproof casing K left side doors 27 and 37 are secured by the hinge 42, respectively. The left side 27 is placed between the front frame 21 and the center frame 41. Meanwhile, another left side 37 is placed between the rear frame 31 and the center frame 41. The left sides 27 and 37 are double-leafed hinged doors and the center frame 41 being the boundary between the side 27 and the side 37.

In the right side of the soundproof casing K, there are provided two right side doors (not shown) of the double-leafed hinged doors and the center frame 41 being the boundary between the two right sides. Further, on the upper part of the soundproof casing K between the rear frame 21 and the center frame 41, there is provided a rear right side door (not shown) secured by means of the hinge. Under the lower part of the rear right side door, there is provided a lower panel (not shown) on which output terminals are installed. The lower panel is secured by means of the hinge.

There is provided a control Box S including control parts to control the operation panel and the generator inside the rear right side door.

On the surface of the roof of the soundproof casing K, there are provided a front roof panel 25 and a rear roof panel 35. Both ends of the front roof panel 25 are bent and the bent portions are hung down.

At the portion opposite to the second muffler room 2B of the front roof panel 25, there is formed a first muffler room air exhaust aperture 25*a* to exhaust the cooling air introduced from the first muffler room 2A and the air flow duct and a radiator room air exhaust aperture 25*b* to exhaust the cooling air introduced from the radiator room 3 is also formed. Further, both sides of the rear roof panel 35 are bent. On the both sides there are formed engine room air intake apertures 35*a* to introduce the cooling air to the engine room 1.

In order to prevent the noise from leaking out from the soundproof casing K and to prevent foreign matters from being introduced into the soundproof casing K, there are provided louvers in the engine room air intake apertures 31*a*, 35*a* and the radiator room air intake aperture 22*a*. Also, there are provided punched holes in the first muffler room air exhaust aperture 25*a* and in the radiator room air exhaust aperture 25*b*.

(3) Overall Construction within the Soundproof Casing K

As sown in FIG. 3–FIG. 6, the soundproof casing K comprises the engine room 1, the muffler room 2 (2A, 2B) and the radiator room 3. The radiator room 3 and the muffler room 2B are communicated by the upper aperture 51*a* and the engine room 1 and the first muffler room 2A and the second muffler room 2B are communicated by means of the air flow duct 4.

A bottom plate 65 partitions the muffler room 2, the radiator room 3 and the air flow duct 4 and there is compactly provided a fuel tank T near the partitioned part of said muffler room 2 and the radiator room 3. (Refer to FIG. 4.)

There is provided a side separation wall 51 at rear end of the front frame 21 to comprise the soundproof casing K. The side separation wall 51 spreads to the full width of the rear end. There is provided a lateral separation wall 52 crossing at right angle to said side separation wall 51 between the front part of the front frame 21 and the side separation wall 51. It is observed from the rear frame 31 direction that the left side is the radiator room 3 and the right side is the first muffler room 2A composing a part of the muffler room 2.

In the side separation wall 51 of the radiator room 3, there is provided an upper part aperture 51*a* communicated with the muffler room 2B and a lower part aperture 51*e* communicated with the duct member 67 constituting the air flow duct 4. There is provided in the lateral separation wall 52 a lateral lower part communication hole 52*a* to which the duct member 67 is connected. The air flow duct 4 makes use of a part of the lower space of the radiator room 3. (Refer to FIG. 6.)

Like that, the radiator comprises the front frame 21, the front door 22, the side separation wall 51, the lateral separation wall 52, the bottom plate 65 and the duct member 67 of the air flow duct 4.

In the radiator room 3, there is provided the radiator R communicated with the engine E by means of the radiator hose 11, said radiator R being provided with a sealing member 63 between the side separation wall 51 and faces to the upper part aperture 51*a* communicating the second muffler room 2B. There is provided an electric fan D to cool the radiator R between the radiator room air intake aperture 22*a* and the radiator R by means of a bracket 43.

Accordingly, the cooling air introduced to the radiator room 3 through the radiator room air intake aperture 22*a* provided in the front door 22 travels after passing the radiator R, passing through the upper aperture 51*a*, the second muffler 2B and is exhausted from the radiator room air exhaust aperture 25*b* formed on the front control panel 25 corresponding to the radiator room 3. (Refer to FIG. 6 and FIG. 9.)

Under the upper aperture 51*a* of the side separation wall 51, there is provided a through hole 51*d* of the radiator hose 11. The radiator hose 11 passes through the through hole, said through hole being provided with a sealing member (not shown).

The muffler room 2, as shown in detail in FIGS. 3, 4, 5 and 6, comprises the first muffler 2A and the second muffler 2B.

The first muffler 2A comprises the front frame 21, the parts except the radiator room 1 of the front door 22, the lateral separation wall 52 and the side separation wall 51.

In the side separation wall 51, there is provided the lower communication hole 51*b* communicating to the air flow duct 4 of the engine 1 side and the upper communication hole 51*c* connecting the second muffler 2B in the side of the second muffler room 2A. At the portion under the upper aperture 51*a* of the radiator room 3 side, there is provided an inclined separation wall 53 to the rear frame 31 direction with substantially the same width. Opposite to said inclined separation frame 53, a horizontal partition plate 56 of rectangular configuration having an aperture 56*a* is provided. Meanwhile, the inclined separation wall 53 is not provided under the horizontal partition plate 56. Both sides of the inclined separation wall 53 are provided with upper side plates 54A, 54B of triangular configuration.

Further, the upper part of the inclined separation wall 53, the upper side plates 54A and 54B are joined to the portion comprising a bottom part 25*c* and a bottom plate 29 of the front panel 25.

In this construction, the second muffler room 2B comprises the side separation wall 51, the inclined separation wall 53, the upper side plates 54A, 54B, the bottom plate 29, the partition plate 28 and the front roof panel 25.

In the front roof panel 25, there is provided a radiator room air exhaust aperture 25*b* at the location corresponding to the upper aperture 51*a*. Meanwhile, there is provided a first muffler room air exhaust aperture 25*a* at the location corresponding to the location of the upper communication hole 51*c*.

There is formed a check hole of triangular configuration in the left and the right upper side plates 54A and 54B. The check hole is screwed with a cover 55 of triangular configuration.

Further, as aforementioned, the construction of the rear part of the first muffler room 2A is such that a space part of the air flow duct 4 to communicate the lower communication hole 51*b* of the side separation wall 51 and the second muffler room 2B communicating the first muffler room 2A through the upper communication hole 51*c* are formed by means of the inclined separation wall 53, the left and the right upper side plates 54A, 54B, the horizontal partition plate 56 and the vertical separation wall 57.

In the width direction of the upper part of the second muffler 2B there is laterally provided the second muffler M2. The second muffler M2 is communicated to the second muffler room 2B by means of the engine E and the second exhaust tube 13.

In the first muffler room 2A, there is vertically provided the first muffler M1 secured to the side separation wall 52 and communicated to the second muffler M2 by means of the first exhaust tube 14. The tip end of the exhaust pipe 15 is faced directly opposite the exhaust aperture 24*a* of the front frame 21.

At the lowest portion of the first muffler M1 there is provided a water drain hole 16*c* to exhaust the rain wall introduced from the tip end of the exhaust pipe 15. Further, at the lower part a guide plate 16 of channel configuration is upwardly provided.

Like that a complex duct construction is formed in the muffler room 2.

The cooling air is introduced to the first muffler room 2A through the lower communication hole 51*b,* the lower part aperture 51*e* and lateral lower communication hole 52*e* from the air flow duct, the air cool the side of the first muffler room M1 as going upward in the first muffler room 2A. The cooling air is introduced to the second muffler room 2B passing through the upper communication hole 51*c*. The air introduced to the second muffler room 2B through the aperture 56*a* of the horizontal partition plate 56 from the air flow duct is partly exhausted as cooling the side of the second muffler M2 and most of them are directly exhausted from the first muffler room exhaust aperture 25*a* of the front roof panel 25.

The engine room comprises most part of the soundproof casing K except the muffler room 2, the radiator room 3 and the air blow duct 4. The engine room 1 comprises the rear frame 31 and the rear roof panel 35. The engine room air intake apertures 31*a,* 35*a* are formed, respectively.

In the engine room 1 there is provided consecutively, the rear frame 31, the generator unit G and the engine E whose output axis of the rear end is connected to the generator unit G. The engine fan F is directly provided at the front end of the engine E. The engine E drives the engine fan F and the engine fan is provided directly opposite to the entrance of the air flow duct.

At the end of the engine E side of the generator unit G, there is provided a generator fan (not shown) to introduce a cooling air to the generator unit G.

In the engine room 1 there are provided a control box S, operation apparatus and other apparatuses (not shown), except the engine E and the generator unit G.

A blowby hose 17 having a sharpened tip end configuration is protruded on the inclined separation wall 53. The blowby hose 17 is located obliquely toward the front frame 21. At the protrusion part of the inclined separation wall 53 there is provided a channel type member 44 to drop off the oil of the blowby gas and to introduce the gas upwardly. The channel type member 44 is a duct to lead the gas upward. There is protruded a tip end of said blowby hose 17 in the duct. The blowby hose 17 is used to treat the blowby gas issued from the engine E. The gas is exhausted from the radiator room air exhaust aperture 25*b,* together with the cooling air issued from the radiator room 3. The oil is dropped off vertically from the channel type member 44 and along the side separation wall 51. The oil is excluded to the outside of the base B.

Figure 6:
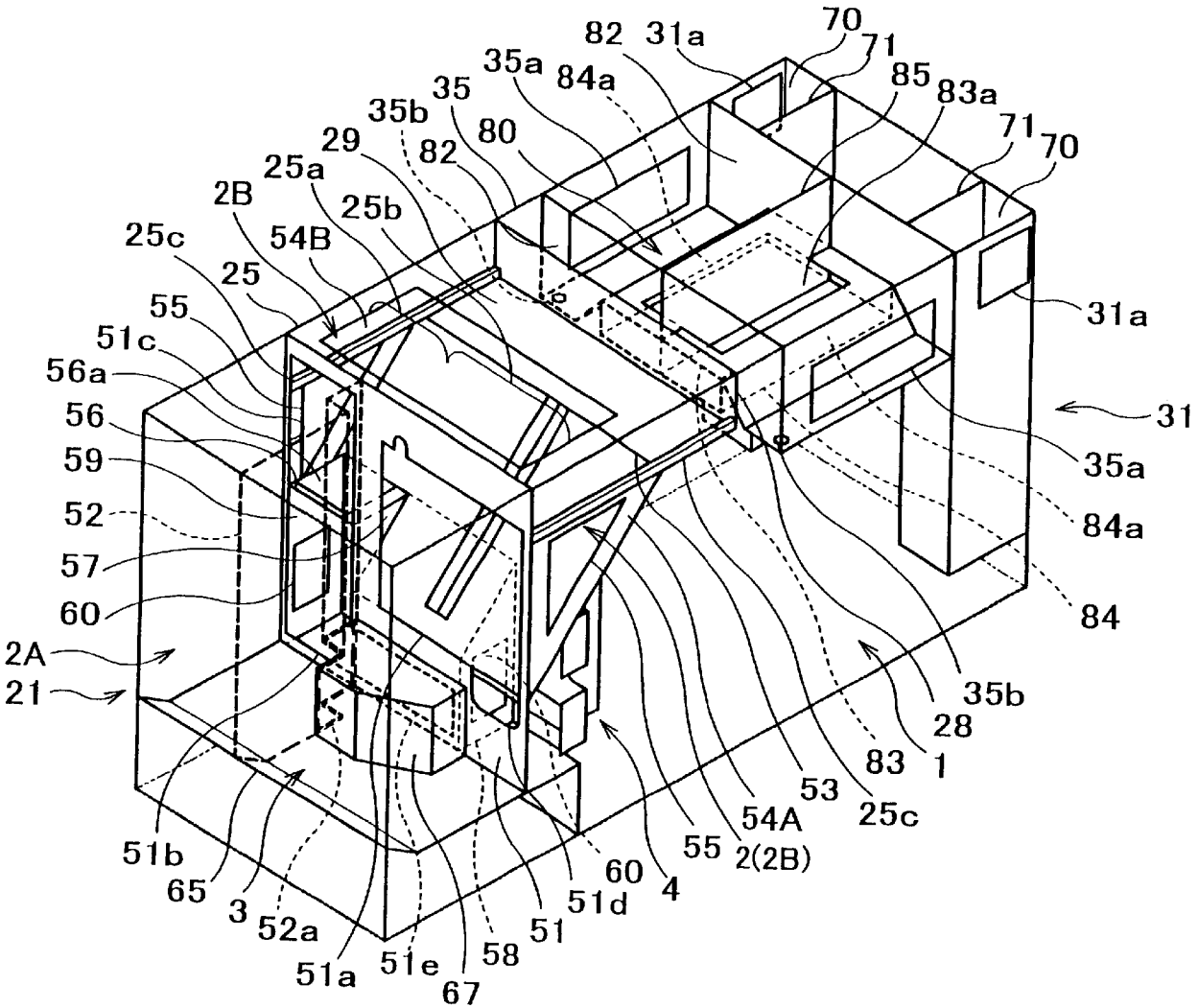
FIG. 6 is a perspective view illustrating the overall construction of a soundproof casing of the soundproof type engine driven work machine (generator) according to the present invention.

As shown in FIG. 6, the rear frame duct 70 is a air flow passage to lead the cooling air into the soundproof casing K through the two engine room air intake apertures 31*a* provided on both sides of the rear frame 31. The rear frame duct 70 comprises the corner of the rear frame 31 and a duct member 71 having L configuration which is vertically suspended from the ceiling of the rear frame. The duct member 71 is supported with clearance to the bottom member (not shown) of the base plate B. The cooling air is introduced to the engine room 1 through the under part of the rear frame duct 70 through the clearance.

In the rear roof panel 35 the rear roof duct which is an air flow passage to introduce the cooling air in the soundproof casing K from the engine room air intake aperture 35*a* is formed.

The rear roof duct 80 is welded to the rear roof panel 35, both ends of the rear roof panel are vertically provided, the partition wall 82, both ends are vertically provided in the longitudinal direction of the soundproof casing K and to the both ends of the rear roof panel 35. The rear roof duct 80 comprises a horizontal member 83 having a protrusion part and trapezoidal configuration in front view and under such protrusion part there is provided a member 84 having an updraft channel configuration. An aperture 83*a* is provided substantially in the center of the protrusion part. There are also provided an apertures 84*a* at both sides of the updraft channel in the width direction.

The cooling air introduced from the engine room air intake aperture 35*a* is led to the upper part of the generator unit G through the apertures 83*a,* 84*a*.

In the substantial center of the rear roof duct 80 there are vertically provided a partition plate 85 divided left and right in the width direction of said rear roof duct 80.

There is provided a drain hole 35*b* on the bottom part inside the engine room air intake aperture 35*a* of the rear roof panel 35. Rainwater introduced to the engine room together with the cooling air is exhausted from said drain hole 35*b*.

The air flow duct 4 is provided to change the stream of the cooling air in the longitudinal direction of the soundproof casing K by the engine fan F to the width direction, and further the cooling air is led to the first muffler room 2A through the side lower communication hole 52*a* of the side separation wall 52. The cooling air is once turned a part of air flow to the width direction the cooling air is again change its direction to the longitudinal direction and is led to the first muffler room 2A through the lower communication hole 51*b* of the side separation wall 51. Further, other part of the cooling air is led to the second muffler room 2B through the aperture 56*a* of the compartment plate 56 by changing the direction toward upwardly after once changing to width direction.

As shown in FIG. 4 and FIG. 6, the air flow duct 4 comprises the side separation wall 51, the inclined separation wall 53, the left and right lower side plates 58, 59, the bottom plate 65, an engine fan shroud 61, a bracket 62 and a duct member 67.

The engine fan shroud 61 comprises a fan guard 61*a* to surround the circumference of the engine fan F and a plate member 61*b*. (Reference is made to FIG. 3.)

The plate member 61*b* has an aperture 66 at the engine E side. The engine fan directly faces opposite to the aperture 66. The side contrary to the engine E has an overall aperture. The engine fan shroud 61 is connected to the left and right lower side plates 58, 59 provided at the lower part of the connected part of the side separation wall 51 and the inclined separation wall 53 and to the bottom plate 65 by means of the bracket 62 of a duct configuration. The engine fan shroud is provided substantially width direction of the soundproof casing K.

At the side of engine E of the plate member 61*b* of the engine fan shroud 61 a fine guard 61*a* providing a plurality of slit openings around the aperture is vertically provided. The aim of the fan guard 61*a* is of course to prevent risks and to protect the foreign matters coming in.

The duct member 67 is provided to form a lower aperture 51*e* of the side separation wall 51 in the radiator room 3 and also to form a space to connect said lower aperture 51*e* and the side lower communication hole 52*a* of the lateral separation wall 52. The connection part to the side separation wall 51, the lateral separation wall 52 and the bottom plate 65 is opened. The duct member 67 is a member of box configuration.

The lower communication hole 51*b* is provided at the place opposite to the first muffler room 2A of the side separation wall 51. The side lower communication hole 52*a* is provided at the place opposite to the first muffler room 2A of the lateral separation wall 52. The aperture 56*a* is provided on the horizontal compartment plate 56 of the second muffler room 2B. The air flow duct 4 which communicates the engine room 1 and the first muffler room 2A is formed in the space surrounded with the engine fan shroud 61, the bracket 62, the left and right lower side plates 58, 59, the side separation wall 51, the inclined separation wall 53, the guide member 67, and the bottom plate 65.

Just in front of the engine fan F of the bracket 62 of duct configuration there is provided an inter-cooler I in the width direction of the soundproof casing K. The cooling air introduced in the bracket 62 by means of engine fan F is led passing through the core part of the inter-cooler I. The left and right lower side plates 58, 59 are provided with a check hole of rectangular configuration. The check hole is also provided with a rectangular cover 60.

(3) Work

Figure 7:
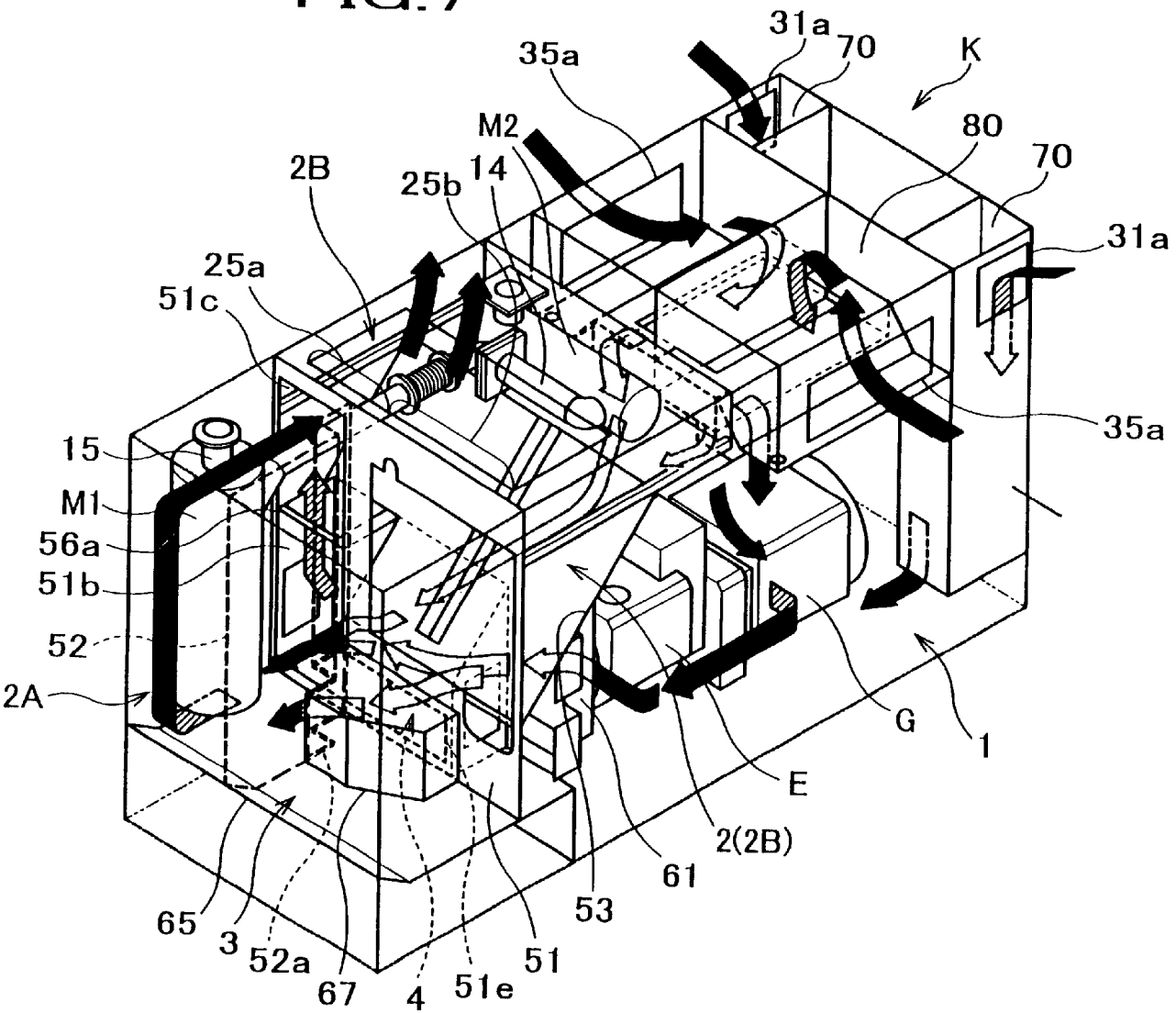
FIG. 7 is a perspective view indicating the flow of the cooling air in an engine room and a muffler room of the soundproof type engine driven work machine (generator) according to the present invention (the radiator and an electric fan are omitted).
Figure 8:
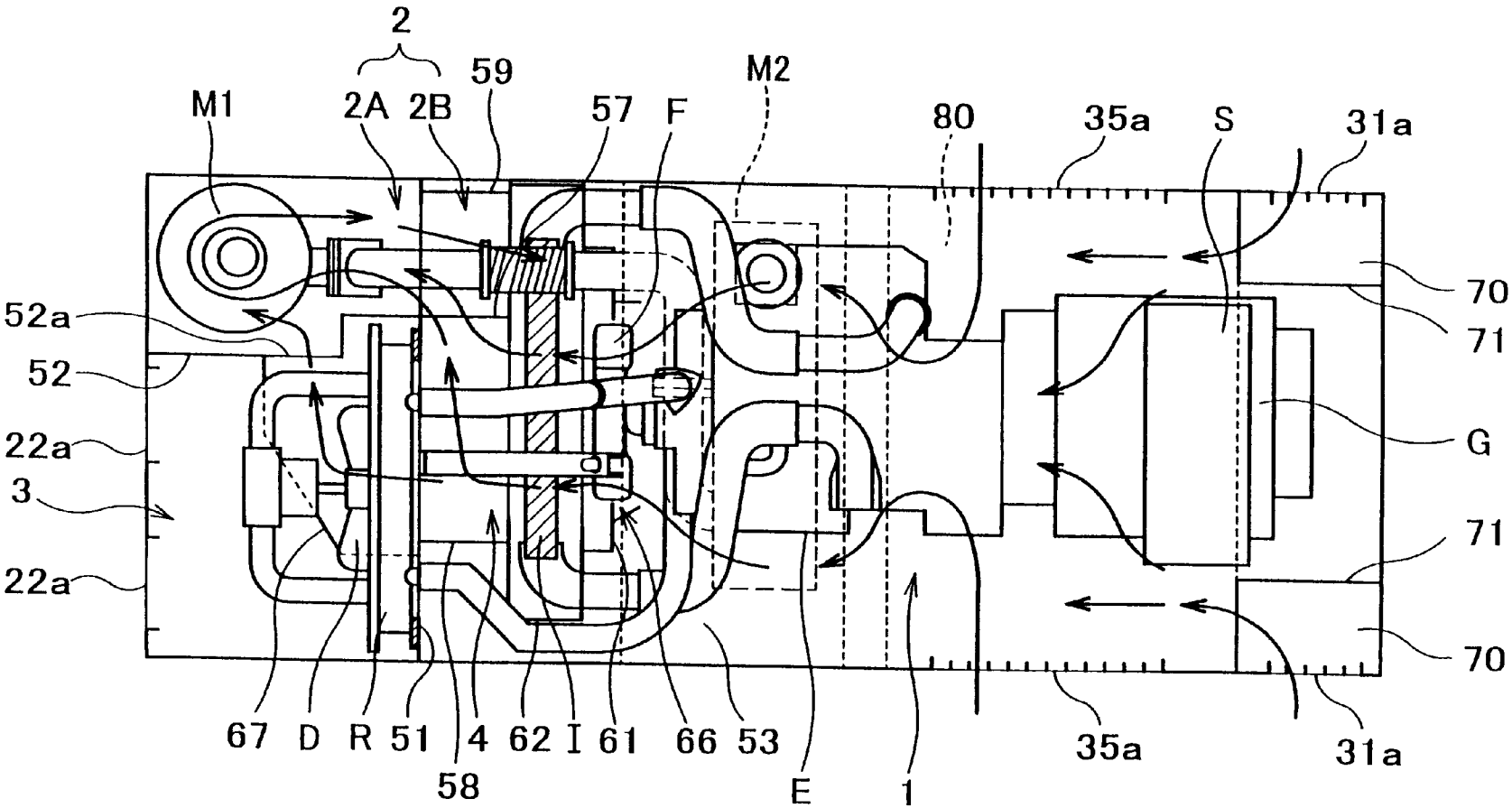
FIG. 8 is a plan view indicating the flow of the cooling air in the engine room and the muffler room of the soundproof type engine driven work machine (generator) according to the present invention.

The generator according to the present invention is constructed as aforementioned. The work of the generator is as follows:

As shown in FIG. 7 and FIG. 8, the cooling air to cool each apparatus accommodated within the engine room 1, the air flow duct 4 and the muffler room 2 is introduced by means of rotation of the engine fan F The cooling air is partly introduced to the engine room 1 from the lower part of the generator unit G through the rear frame duct 70 introduced from the engine room air intake aperture 31*a*. Another part of the cooling air is introduced to the engine room 1 from the upper part of the generator unit G and the engine E passing through the rear roof duct 80 after introduced from the engine room air intake aperture 35*a*.

The cooling air introduced from the lower part of the engine room 1 is led to the air flow duct 4 passing through the aperture 66 in the plate member 61*b* of the engine fan shroud 61 as cooling the generator unit G and the engine E. Meanwhile, the cooling air introduced from the upper part of the engine room 1 is led to the air flow duct 4 passing through the aperture 66 of the plate member 61*b* as cooling the control box S, the generator unit G and the engine E.

The cooling air introduced to the air flow duct 4 cools the inter-cooler I and partly change the direction at right angle as being introduced by the duct member 67 flows to the first muffler room 2A through the side lower communication hole 52*a* of the lateral separation wall 52. Another part of the cooling air collide the side separation wall 51 and change the direction by right angle. The cooling air again changes its flowing direction to the longitudinal direction and is led to the first muffler room 2A passing through the lower communication hole 51*b* of the side separation wall 51. Further, another part of the cooling air collides side separation wall 51 and change its flowing direction by right angle and again change its direction upward and is introduced to the second muffler room 2B through the aperture 56*a* of the horizontal compartment plate 56.

The cooling air introduced to the first muffler room 2A goes up in the first muffler room 2A to cool the first muffler M1 and then fold its flowing direction to pass the upper communication hole 51*c* and is led to the second muffler room 2B and meet with the cooling air introduced to the second muffler room 2B through the aperture 56*a* of the horizontal compartment plate 56. The cooling air changes its flowing direction to the upper direction along the inclined separation wall 53. The cooling air is exhausted from the first muffler room air exhaust aperture 25*a* after cooling the second muffler M2.

Like that, the cooling air introduced to the engine room 1 is not required to cool the radiator R. Thus the amount of the cooling air is reduced. The size of the engine fan F is reduced. The area of the engine room air intake apertures 31*a*, 35*a* and the first muffler room air exhaust aperture 25*a* is also reduced. Further, it is possible to form a complex duct passages by combining the air flow duct 4 and the muffler room 2 to push back the pressure. The unfavorable noise of engine sound and the muffler sound are greately decreased.

As the first muffler room air exhaust aperture 25*a* is provided in the front roof panel 25, the cooling air is led to the first muffler 2A and the second muffler 2B. The cooling air flows upward as cooling the first muffler M1 and the second muffler M2. The cooling air is naturally exhausted from the first muffler air exhaust aperture 25*a*. The cooling efficiency is greatly improved. The cooling air exhausted from the first muffler room air exhaust aperture 25*a* is prevented from being involved to the engine room air intake apertures 31*a*, 35*a* and the radiator room air intake aperture 22*a*.

The unfavorable noise from the first muffler room air exhaust aperture 25*a* is diffused through the ceiling part of the soundproof casing K. The workers and the operators are not much troubled by the unfavorable noise occurred near the generator while they are working.

The cooling air to cool the radiator R is introduced to the soundproof casing K by means of the electric fan D apart from the engine fan F. For this reason, the amount of the exhausting air causing the noise of the engine fan F is decreased to a minimum. Thus overall noise is greatly reduced.

Figure 9:
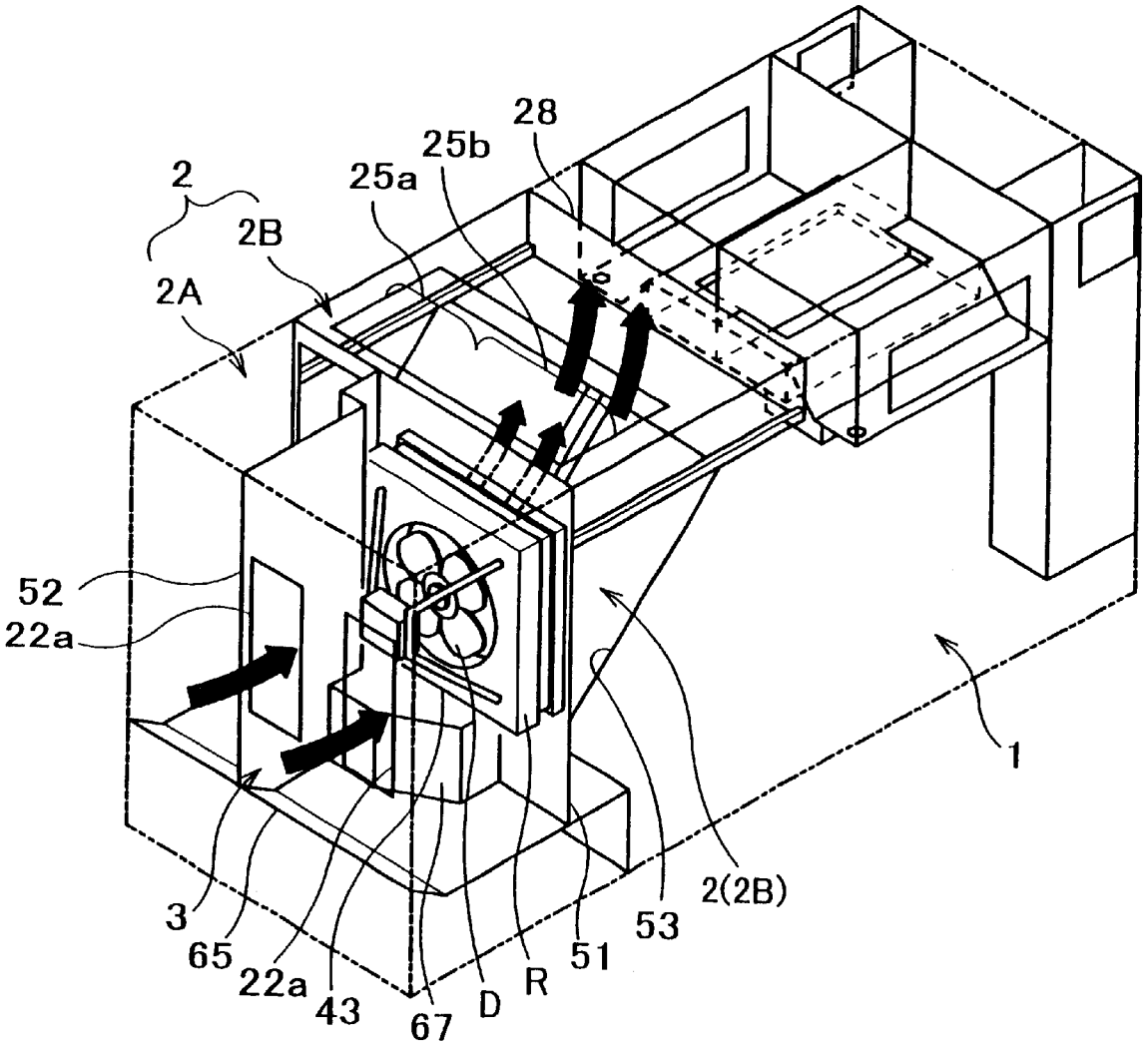
FIG. 9 is a perspective view indicating the flow of the cooling air in the radiator room of the soundproof type engine driven work machine (generator) according to the present invention (the muffler is omitted).

As shown in FIG. 9, the cooling air is aligned by rotation of the electric fan D and introduced to the radiator room 3 from the radiator room air intake aperture 22*a*. The cooling air cools the electric fan D and the radiator R and then is introduced to the second muffler room 2B after passing through the upper aperture 51*a*. The cooling air changes its direction upward and is exhausted from the radiator room air exhaust aperture 25*b* of the front roof panel 25 after cooling the second muffler M2.

Accordingly, by the rotation of the electric fan D, the cooling air whose temperature has not been raised is introduced to the radiator room 3. The cooling air can cool the electric fan D most effectively. Further, the cooling air used for cooling only the electric fan D is again used for cooling the radiator R. The temperature of the cooling air used for cooling only the electric fan D is not raised so much and yet the cooling air is again used for cooling the radiator R. Thus, cooling efficiency for the radiator R is far improved.

The electric fan D is not limited or less limited to its installing space and place. In design, ordinary skilled engineers have the freedom of selection of the electric fan. It is also possible to select the electric fans of lower noise and smaller size for ordinary skilled engineers. As it is restricted to the cooling capacity to cool only the radiator R the amount of the cooling air is reduced when compared with the conventional apparatus. Further, the opening areas of the radiator room air intake aperture 22*a* and the radiator room air exhaust aperture 25*b* are reduced and it is possible to impart backpressure. The wind noise caused in the radiator R is reduced due to small sized capacity of the electric fan D. Further, by the effect of shielding the noise by the electric fan D together with the effect of duct existed due to the side separation wall 51 and the inclined separation wall 53, the unfavorable noise is greatly reduced.

There is provided the radiator room air in the front roof panel 25. Absorving the heat of the electric fan D and the radiator R raise the temperature of the cooling air. The cooling air goes upward and is exhausted from the radiator room air exhaust aperture 25*b*. Thus exhausting efficiency is very improved. The exhausted cooling air is prevented from being involved in the engine room air intake apertures 31*a*, 35*a* and the radiator room air intake aperture 22*a*.

As aforementioned, the engine room 1, the muffler room 2 and the radiator room 3 are partitioned, the stream of the cooling air passing the engine room 1 to the second muffler room 2B by the rotation of the engine fan F is perfectly separated from the other stream of the cooling air which passes from the radiator room 3 to the second muffler room 2B by rotation of the electric fan F. Both streams of the cooling air are independent each other. The cooling air by rotation of the electric fan D cools the radiator R only. Meanwhile, the cooling air by rotation of the engine fan F cools the control box S, the generator unit G, the engine E, the inter-cooler I, the first muffler M1 effectively. In addition, the size of the inter-cooler I, the radiator R and the engine fan F is reduced. Accordingly, the size of the soundproof casing K to accommodate the above mentioned apparatus is also reduced.

If the radiator made of aluminum is applied for the material of the radiator, the size of the radiator is reduced. It goes without saying that the cooling efficiency is further improved.

The inter-cooler and the radiator, which are of larger combustion heat, are provided separately so that they may not be affected with their heat, the cooling efficiency is far improved. Cleaning work for the inter-cooler I and the radiator R is easy.

It is possible to reduce the amount of the cooling air to be introduced into the soundproof casing K. Rainwater and dust to the soundproof casing K are greatly prevented from invading. Thus, insulation or obstruction of the generator is also prevented.

If the electric fan D of the radiator room 3 should be stopped because of some unknown reasons, the air exhaust aperture 25*a* and the radiator room air exhaust aperture 25*b* are closed to lead the cooling air caused by the engine fan F to the muffler rooms 2A, 2B to the radiator room 3 to cool the radiator, the cooling air is exhausted from the radiator room air intake aperture 22*a*. For this reason, when lower load operation is required, it is possible to operate the generator continuously.

We think we have fully explained an example of the preferred embodiments of the present invention.

While the invention has been shown and described with reference to the illustrated embodiments, it should be understood that various changes in forms and details might be made without departing from the scope of the invention which is defined in the appended claims. In particular, partitioning method of the engine room, the muffler room and the radiator room in the soundproof casing, size of each compartment are preferably determined in accordance with industrial standard of each apparatus and layout comprising the work machine. Number of air intake apertures and air exhaust apertures are also preferably determined.

It is of course possible to partition the inside of the soundproof casing more than the compartments for the engine room, the muffler room and the radiator room. Any more apparatuses can be accommodated if necessary.

The scope of the present invention is of course not limited to the generator only. If the work machine with the aforementioned structure, the soundproof type engine driven work machine can be applied not only to the generator but also to the welding machines or compressors of any type.

EFFECTS OF THE INVENTION

The soundproof type engine driven work machine according to the present invention is composed as aforementioned. It is possible to improve the cooling efficiency extraordinarily as well as reducing the unfavorable noise. Further, it is possible to reduce the size of said soundproof casing.

What is claimed is:

1. A soundproof type engine driven work machine including an engine having an engine fan, a work machine unit driven by the engine, a radiator, a charge cooler and mufflers communicated to the engine, a soundproof casing to accommodate said work machine in the casing, the soundproof type engine driven work machine further comprising:

a soundproof casing is partitioned into an engine room, a muffler room and a radiator room, the engine room accommodates the engine, the work machine unit and an air intake aperture, the muffler room accommodates the muffler and an air exhaust aperture, the radiator room accommodates the radiator and an air intake aperture, the radiator room and the muffler room are communicated, an electric fan is provided between the air intake aperture of the radiator room and the radiator, further, an air flow duct to communicate said engine room and said muffler room, the engine fan being provided directly opposite to an entrance of said air flow duct, and the charge cooler is provided in said air flow duct.

2. The soundproof type engine driven work machine according to claim 1, wherein the air exhaust aperture of the muffler room is provided in a ceiling of the soundproof casing.

* * * * *